US005477433A

United States Patent [19]

Ohlund

[11] Patent Number: 5,477,433

[45] Date of Patent: Dec. 19, 1995

[54] ILLUMINATED NECKLACE

[76] Inventor: Stephen K. Ohlund, 1533 Osos St., San Luis Obispo, Calif. 93401

[21] Appl. No.: 221,762

[22] Filed: Apr. 1, 1994

[51] Int. Cl.[6] ..... F21L 15/08

[52] U.S. Cl. ..... 362/104; 362/183; 362/391; 362/800; 362/806; 63/1.1; 63/2

[58] Field of Search ..... 362/103, 104, 362/108, 183, 391, 800, 806; 63/1.1, 2

[56] References Cited

U.S. PATENT DOCUMENTS

| | | | |
|---|---|---|---|
| 3,383,503 | 5/1968 | Montgomery | 362/104 |
| 3,689,758 | 9/1972 | Power | 362/104 |
| 4,093,973 | 6/1978 | Vaagenes | 362/104 |
| 4,173,229 | 11/1979 | Halfon | 63/1.1 |
| 4,262,324 | 4/1981 | Murphy | 362/104 |
| 4,271,457 | 6/1981 | Martin | 362/104 |
| 4,298,917 | 11/1981 | Ware | 362/103 |
| 4,779,172 | 10/1988 | Jiminez et al. | 362/104 |
| 4,942,744 | 7/1990 | Wei | 63/1.1 |
| 5,018,053 | 5/1991 | Belknap et al. | 362/104 |
| 5,268,826 | 12/1993 | Greene | 362/103 |

FOREIGN PATENT DOCUMENTS

| | | | |
|---|---|---|---|
| 2315237 | 1/1977 | France | 63/1.1 |
| 2347607 | 4/1977 | France | 362/104 |

*Primary Examiner*—Ira S. Lazarus
*Assistant Examiner*—Alan B. Cariaso
*Attorney, Agent, or Firm*—John J. Connors; Connors & Associates

[57] ABSTRACT

An illuminated necklace is disclosed that includes a metallic chain separated into two chain portions. One end of each portion is connected to a pendant that includes an illuminated element, such as a lamp or LED. The other end of each portion is connected to a clasp component that includes a power source. As such, an electrical circuit is formed between the power source, through the first chain portion, through the illuminated element, through the second chain portion, and back to the power source. The chain comprises a plurality of interlocking, separate chain elements that are of such a size and shape that the movement of the chain elements with normal body movement causes the chain elements to move into and out of contact with each other. As such, the illuminated element flickers intermittently.

2 Claims, 2 Drawing Sheets

ILLUMINATED NECKLACE

FIELD OF THE INVENTION

This invention relates generally to illuminated jewelry, and, more particularly, is directed towards an illuminated necklace that flickers intermittently.

BACKGROUND OF THE INVENTION

Illuminated jewelry has been known in the prior art for some time. For example, see U.S. Pat. No. 5,018,053 to Belknap et al. on May 21, 1991; U.S. Pat. No. 4,779,172 to Jimenez et al. on Oct. 18, 1988; U.S. Pat. No. 4,093,973 to Vaagenes on Jun. 6, 1978; and U.S. Pat. No. 4,262,324 to Murphy on Apr. 14, 1981. All of these devices teach illuminated jewelry of varying degrees of complexity. While these devices may be suitable for the particular purpose to which they address, they would not be as suitable for the purposes of the present invention as heretofore described. For example, the Belknap, Vaagenes, and Murphy devices teach jewelry having relatively simple illumination circuits that have no intermittent illumination quality. The Jimenez device does teach an intermittently illuminated quality, but it includes an additional, separate electrical flasher component to accomplish this, which makes such a device relatively expensive to manufacture.

Further, such prior art devices are not suitable for use with a metallic chain, which is aesthetically desirable with pendent type necklaces. While the Murphy device teaches an illuminated pendent and a chain conductor shown in FIG. 5 of the Murphy Patent, the chain conductors as shown tend to short, preventing the pendent from illuminating and quickly draining the battery. Further, the Murphy device does not teach intermittent illumination of the pendent, which is aesthetically desirable and eye catching. The preferred embodiment of the Murphy device includes a wire conductor covered by an "aesthetically pleasing" textile insulator. However, many people feel that such textile insulators are not as aesthetically pleasing as gold, silver, or other types of metallic chains, when used with jewelry.

Still further, all of the prior art devices have the drawback of including replaceable batteries that become drained of energy after prolonged use. Users of such devices, as a result, tend not to illuminate these devices as often as they would like so as to preserve battery life.

Clearly, then, there is a need for an illuminated necklace that is at once inexpensive to manufacture and provides for intermittent illumination of a pendent component. Such intermittent illumination of the pendent component would correlate to some extent to body motion, making such a needed device particularly eye catching and aesthetically appealing. Such a needed device would provide an aesthetically pleasing metallic chain, as well as a variety of illuminated pendent designs. Such a needed device would be solar recharging, thereby allowing for more prolonged and continuous use. The present invention fulfills these needs and provides further related advantages.

SUMMARY OF THE INVENTION

The present invention is an illuminated necklace that includes a metallic chain separated into two chain portions. One end of each portion is connected to a pendant that includes an illuminated element, such as a lamp or LED. The other end of each portion is connected to a clasp component that includes a power source. As such, an electrical circuit is formed between the power source, through the first chain portion, through the illuminated element through the second chain portion, and back to the power source. The chain comprises a plurality of interlocking, separate chain elements that are of such a size and shape that the movement of the chain elements with normal body movement causes the chain elements to move into and out of contact with each other. As such, the illuminated element flickers intermittently.

The present invention is an illuminated necklace that is relatively inexpensive to manufacture and provides for intermittent illumination of a pendent component that is related, to some extent, to body motion. As such, the present invention is particularly eye catching and aesthetically appealing. The present device provides an aesthetically pleasing metallic chain, as well as a variety of illuminated pendent designs. Further, the device is solar recharging, thereby allowing for more prolonged and continuous use. Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
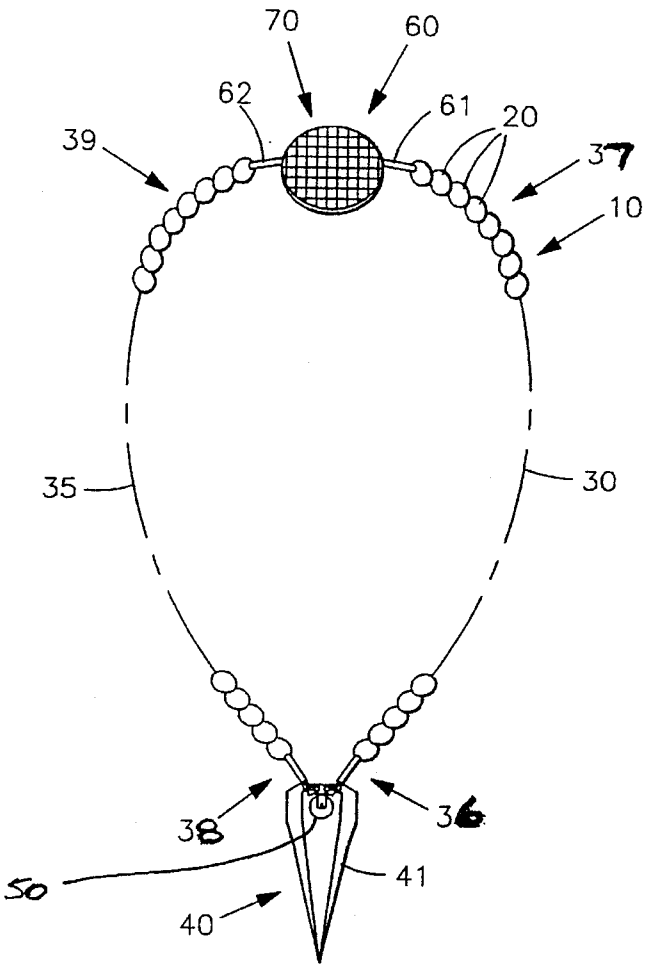
FIG. 1 is a front elevational view of an illuminated necklace, illustrating two portions of a chain, a pendant component, and a clasp component.

FIG. 1 shows an illuminated necklace. A flexible linear chain 10 is made of a metallic material and includes a plurality of interlocking, separate, chain elements 20. The chain 10 comprises a first portion 30 and a separate second portion 35. The first portion 30 has a one end 36 and another end 37, and the second portion 35 has a one end 38 and another end 39.

Figure 2:
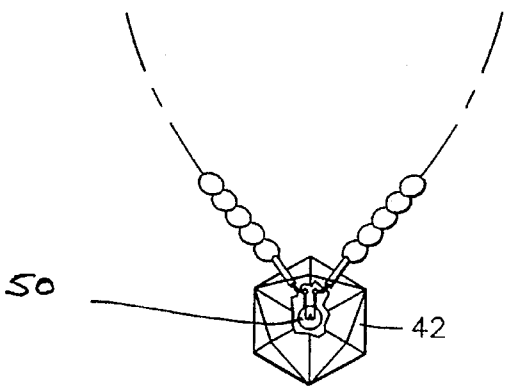
FIG. 2 is a partial front elevational view of the invention, illustrating a decorative stone included in the pendant component of the invention.
Figure 3A:
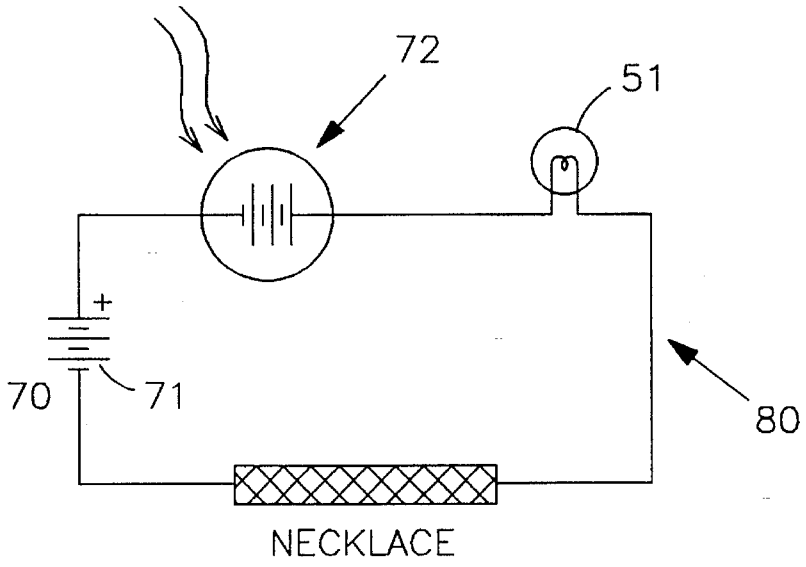
FIG. 3A is a schematic diagram of an electrical circuit of the invention, illustrating a lamp as an illuminated element of the pendant component.
Figure 3B:
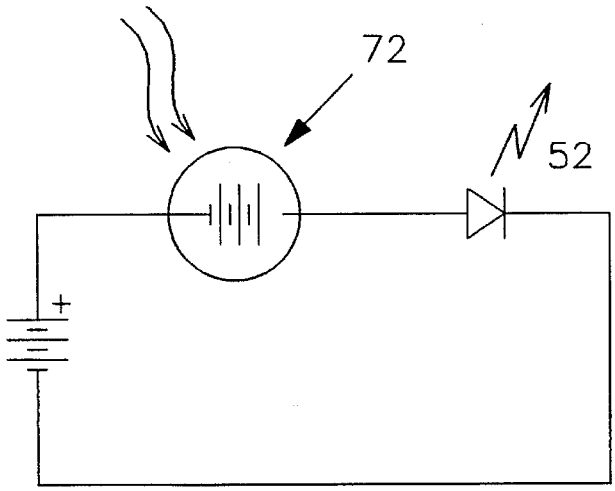
FIG. 3B is a schematic diagram of the electrical circuit of the invention, illustrating a light emitting diode as the illuminated element of the pendant component.

A pendant component 40 is fixedly attached to, and hangs from, the one ends 36,38 of each of the two separate chain portions 30,35. The pendant component 40 further includes an illuminated element 50, energized by a flow of electrical energy therethrough. The illuminated element 50 and the two chain portions 30,35 are connected in series electrical interconnection (FIGS. 3A and 3B). The illuminated element is preferably a lamp 51 (FIG. 3A), or a light emitting diode 52 (FIG. 3B). The pendant component 40 may include a quartz crystal 41 (FIG. 1), a decorative stone 42 (FIG. 2), or any other type of illuminated pendent design that may be fashioned by those skilled in the art.

A clasp component 60 has a pair of clasp elements 61,62, each of which are connected to one of the separate portions 30,35 of the chain 10 at the other of the ends 37,39, respectively. The clasp elements 61,62 are mutually engagable and alternately disengagable for placing the necklace around, and alternately removing the necklace from, a person's neck. The clasp component 60 further includes an electrical energy source 70, such as a battery 71 (FIG. 3A), or a solar powered electrical cell 72 (FIG. 1), which forms a closed electrical circuit 80 with the chain 10 and the illuminated element 50 so that energy flows from the energy source 70, through the first portion 30 of the chain, through the illuminated element 50, and therefrom through the second portion 35 of the chain 10, to return to the energy source 70 in continuous flow (FIGS. 3A and 3B). In one embodiment of the invention, the electrical energy source 70 may include a rechargeable battery 71 that is recharged during the day by the solar cell 72.

The chain elements 20 are each of a size and shape, and the chain 10 is of such a length, that movement of the chain elements 20 with body movement causes the chain elements 20 to move into and out of contact with each other. As such, the illuminated element 50 is caused to flicker intermittently in response to motion of the person. This intermittent illumination is generally correlated to body motion, and as such is eye catching and aesthetically appealing. In another embodiment of the invention, with the chain elements 20 being relatively small and loosely interconnected, the flickering takes on a more random appearance.

While the invention has been described with reference to a preferred embodiment, it is to be clearly understood by those skilled in the art that the invention is not limited thereto. Rather, the scope of the invention is to be interpreted only in conjunction with the appended claims.

What is claimed is:

1. Illuminated jewelry, including a decorative stone including a light emitting diode, a clasp which may be engaged and disengaged, including a rechargeable battery powered by an electrical solar cell, said battery having positive and negative poles, and a conductive, metallic connector attaching the stone to the clasp, said metallic connector having first and second portions, with the battery, decorative stone, and first and second portions of the connector being connected in series, so that electrical current flows from one pole of the battery through the first portion of the connector into the light emitting diode, and then back through the second portion of the connector to the other pole of the battery said jewelry being in the form of a pendant where the conductive connector has first and second flexible, linear metallic chain portions, said first chain portion having one end connected to one pole of the battery and another end connected to the light emitting diode, and said second chain portion having one end connected to the other pole of the battery and another end connected to the light emitting diode, said first and second chain portions each comprising a series of separate, interlocking chain elements which move into and out of contact with body movement to cause intermittent flickering of the light emitting diode.

2. The illuminated jewelry of claim 1 where the decorative stone is a quartz crystal.

* * * * *